US011454141B1

(12) United States Patent
Blackmur et al.

(10) Patent No.: US 11,454,141 B1
(45) Date of Patent: Sep. 27, 2022

(54) TORQUE LIMITED VARIABLE CAMSHAFT TIMING ASSEMBLY

(71) Applicant: BorgWarner Inc., Auburn Hills, MI (US)

(72) Inventors: Shawn Blackmur, Brooktondale, NY (US); Anthony Mattord, Macomb Township, MI (US); Glen Kozeli, Macomb, MI (US); John R. Smerczak, Ortonville, MI (US); Daniel Brown, Freeville, NY (US)

(73) Assignee: BORGWARNER INC., Auburn Hills, MI (US)

( * ) Notice: Subject to any disclaimer, the term of this patent is extended or adjusted under 35 U.S.C. 154(b) by 0 days.

(21) Appl. No.: 17/522,319

(22) Filed: Nov. 9, 2021

(51) Int. Cl.

| | |
|---|---|
| ***F01L 1/352*** | (2006.01) |
| ***F01L 9/22*** | (2021.01) |
| ***F01L 1/46*** | (2006.01) |
| *F01L 13/00* | (2006.01) |

(52) U.S. Cl.
CPC ..... *F01L 1/352* (2013.01); *F01L 1/46* (2013.01); *F01L 9/22* (2021.01); *F01L 2013/103* (2013.01); *F01L 2800/12* (2013.01); *F01L 2820/032* (2013.01)

(58) Field of Classification Search
CPC ..... F01L 1/352; F01L 1/46; F01L 2013/103; F01L 2800/12; F01L 2820/032
USPC ..... 123/90.15, 90.17
See application file for complete search history.

(56) References Cited

U.S. PATENT DOCUMENTS

| | | | |
|---|---|---|---|
| 4,056,953 | A | 11/1977 | Furlette et al. |
| 4,263,711 | A | 4/1981 | Sakano et al. |
| 4,617,484 | A | 10/1986 | Buijsen |
| 4,687,392 | A | 8/1987 | Bidwell |
| 5,684,348 | A | 11/1997 | Main |
| 6,443,846 | B1 | 9/2002 | Dziedzic et al. |
| 6,608,421 | B1 | 8/2003 | Hamilton et al. |
| 6,720,702 | B2 | 4/2004 | Knauff |
| 6,948,464 | B2 | 9/2005 | Ido et al. |
| 8,083,596 | B1 | 12/2011 | Silver et al. |
| 9,249,692 | B2 | 2/2016 | Menonna et al. |
| 9,388,713 | B2 | 7/2016 | Lettmann et al. |
| 9,810,108 | B2 | 11/2017 | Pritchard et al. |
| 10,208,775 | B2 | 2/2019 | Wallace |
| 10,550,734 | B2 | 2/2020 | Weber et al. |

(Continued)

FOREIGN PATENT DOCUMENTS

| | | | |
|---|---|---|---|
| DE | 2638538 | A1 | 3/1978 |
| DE | 102014006022 | A1 | 10/2015 |

(Continued)

*Primary Examiner* — Jorge L Leon, Jr.
(74) *Attorney, Agent, or Firm* — Reising Ethington P.C.

(57) ABSTRACT

An electrically-actuated variable camshaft timing (VCT) assembly includes a gearbox assembly including an input; an electric motor having a rotor, a stator, and a motor shaft that is coupled with the input of the gearbox assembly, wherein the motor shaft includes etchings, on an outer surface of the motor shaft, that releasably couple the motor shaft to the rotor at a center aperture of the rotor when an amount of torque exerted on the motor shaft via the gearbox assembly is less than or equal to a predetermined torque value, and the etchings are further configured to decouple the motor shaft from the rotor when the amount of torque exerted on the motor shaft is greater than the predetermined torque value.

15 Claims, 5 Drawing Sheets

(56) References Cited

U.S. PATENT DOCUMENTS

| | | | | |
|---|---|---|---|---|
| 2009/0120388 | A1 | 5/2009 | Lee et al. | |
| 2012/0145104 | A1* | 6/2012 | David | F01L 1/352 123/90.17 |
| 2013/0312682 | A1 | 11/2013 | Schaefer et al. | |
| 2016/0245088 | A1 | 8/2016 | Jevardat De Fombelle et al. | |
| 2021/0270193 | A1* | 9/2021 | Ono | F01L 1/344 |

FOREIGN PATENT DOCUMENTS

| | | | |
|---|---|---|---|
| DE | 10325910 | C5 | 1/2017 |
| DE | 102017113495 | A1 | 12/2018 |
| FR | 2497018 | A1 | 6/1982 |
| GB | 1533026 | A | 11/1978 |
| JP | 5873523 | B2 | 3/2016 |
| WO | WO2010-129539 | A2 | 11/2010 |
| WO | WO2012110131 | A1 | 8/2012 |
| WO | WO2015007276 | A1 | 1/2015 |

* cited by examiner

TORQUE LIMITED VARIABLE CAMSHAFT TIMING ASSEMBLY

TECHNICAL FIELD

The present application relates to variable camshaft timing and, more particularly, to electrically-actuated variable camshaft timing assemblies.

BACKGROUND

Vehicles can include electric motors that carry out a variety of vehicle functions, including, for example, adjusting the angular position of one or more camshafts with respect to the angular position of a crankshaft or adjusting the position of a passenger or driver seat. Electric motors can be used to operate a camshaft phaser to advance or retard the timing of a camshaft with respect to the crankshaft. The camshaft phaser may include a gearbox that is driven by an electric motor. Mechanical stops that limit the range of authority of the camshaft phaser can be included in the gearbox. When the camshaft phaser reaches an end of the range, gearbox movement can be stopped relatively abruptly and a relatively large amount of torque may be applied to the output shaft of the electric motor. This relatively large amount of torque may cause unwanted stress to the camshaft phaser and it would be helpful to reduce this stress.

SUMMARY

In one implementation, an electrically-actuated variable camshaft timing (VCT) assembly includes a gearbox assembly including an input; an electric motor having a rotor, a stator, and a motor shaft that is coupled with the input of the gearbox assembly, wherein the motor shaft includes etchings, on an outer surface of the motor shaft, that releasably engage a center aperture of the rotor when an amount of torque exerted by the gearbox assembly on the motor shaft remains at or below a determined torque value.

In another implementation, an electrically-actuated VCT assembly includes a first ring gear configured to receive rotational input from a crankshaft; a second ring gear configured to couple to a camshaft; a gearbox assembly that engages the first ring gear and the second ring gear to angularly displace the first ring gear relative to the second ring gear, having an input; an electric motor having a rotor, a stator, and a motor shaft that is coupled with the input of the gearbox assembly, wherein the motor shaft includes etchings, on an outer surface of the motor shaft, that releasably engage a center aperture of the rotor.

and

Figure 10:
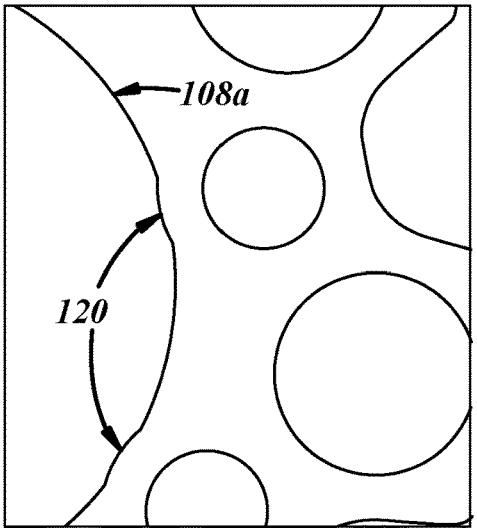

FIG. 10 is a profile view depicting an implementation of a rotor.

DETAILED DESCRIPTION

An electrically-actuated variable camshaft timing (VCT) assembly can include an electric motor, having a rotor and a stator, with a motor shaft that includes an etched outer surface. The etching can extend along an axial length of the outer surface of the motor shaft and may be created by laser ablation. The electrically-actuated VCT assembly—or camshaft phaser—can include a gearbox having an output coupled to a camshaft and an input coupled to the motor shaft of the electric motor. The motor shaft can control the angular position or phase of the camshaft relative to a crankshaft. The gearbox can include mechanical stops that limit the angular displacement of the camshaft relative to the crankshaft. During assembly, the motor shaft and its etched outer surface can be forcibly fit into a center aperture of the rotor creating a defined amount of frictional resistance between the motor shaft and the rotor. The etching can mechanically deform a surface of the center aperture thereby creating the defined frictional resistance.

The defined frictional resistance can be selected to create a torque value at or below which the motor shaft is not angularly displaced relative to the rotor, such as would occur during normal operation when the phaser is changing the phase of the camshaft relative to the crankshaft. However, when the camshaft is angularly displaced relative to the crankshaft such that the mechanical gearbox of the camshaft phaser engages a stop, the amount of torque exerted by the gearbox on the motor shaft can rise above the determined torque value thereby permitting relative angular rotation between the rotor and the shaft. Once the torque exerted on the motor shaft falls below the determined torque value, the laser etched outer surface can once again prevent the angular displacement between the motor shaft and the rotor. This functionality can be repeated, with the etched outer surface holding the rotor relative to the shaft while the torque exerted on the shaft is below the threshold limit and permitting relative angular movement between the shaft and the gearbox above that limit, again and again. Different axial lengths of etchings and/or ablation patterns are possible to alter the determined torque value.

Figure 1:
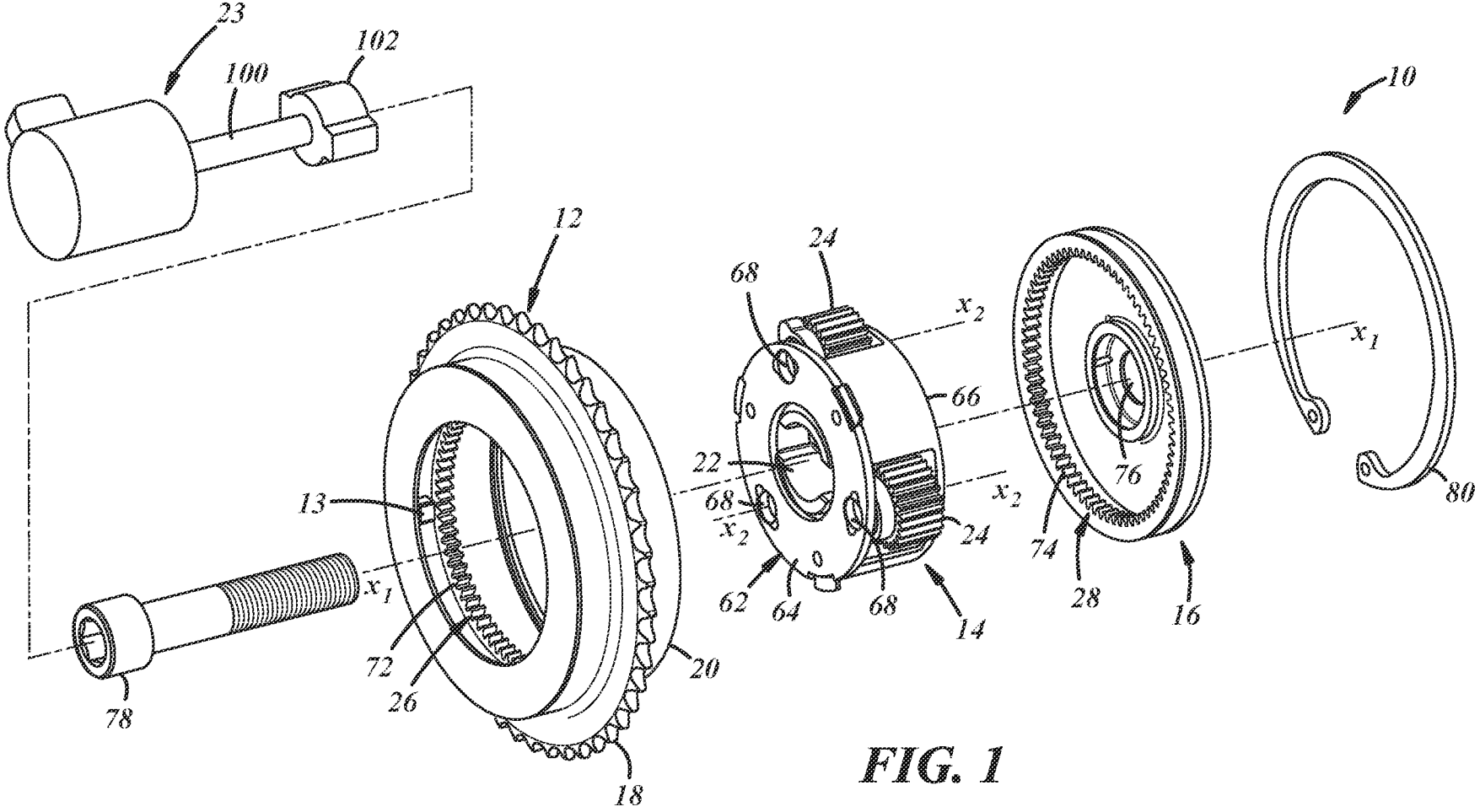
FIG. 1 is an exploded view depicting an implementation of an electrically-actuated variable camshaft timing (VCT) assembly.
Figure 2:
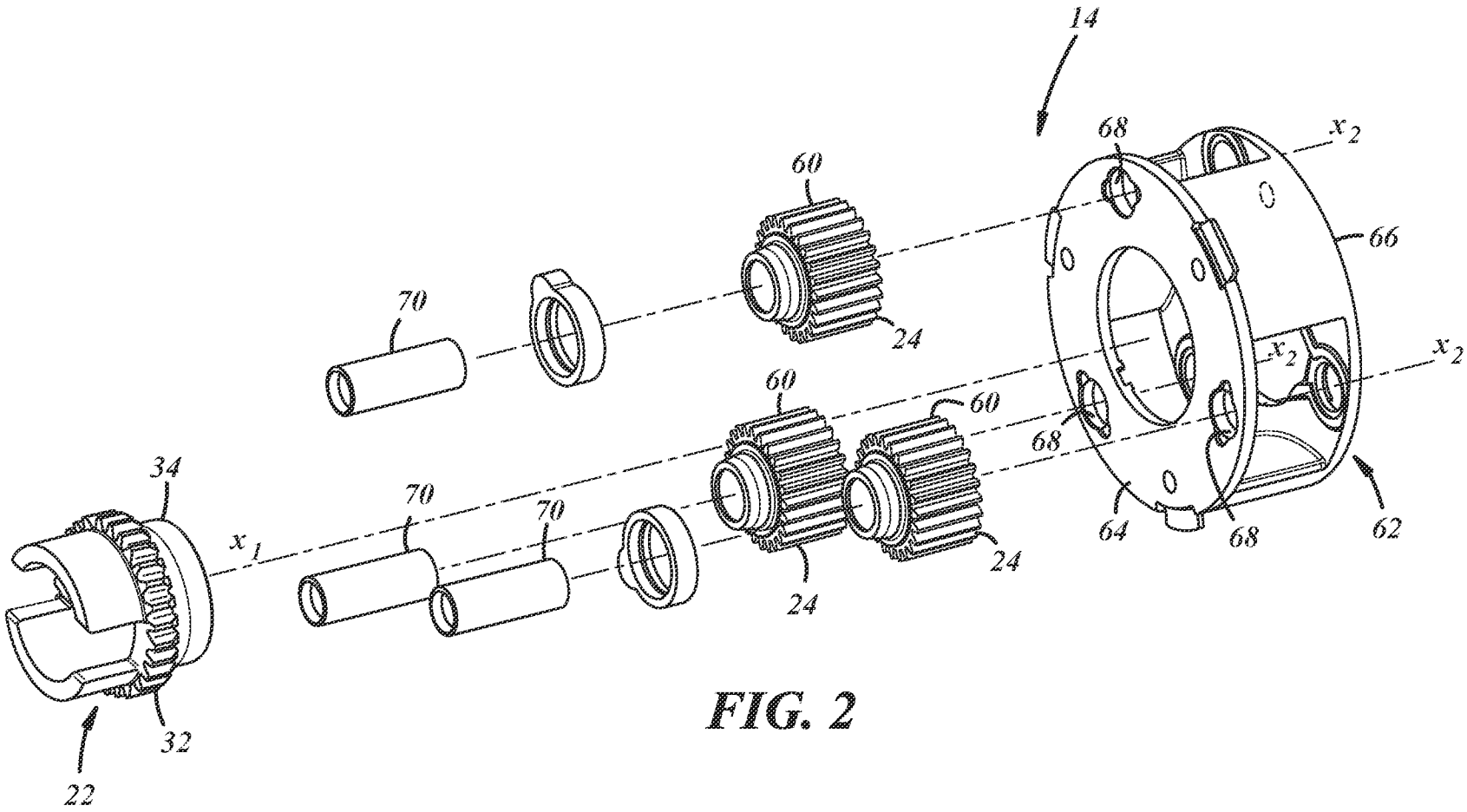
FIG. 2 is an exploded view depicting an implementation of a gearbox assembly used with an electrically-actuated VCT assembly.
Figure 3:
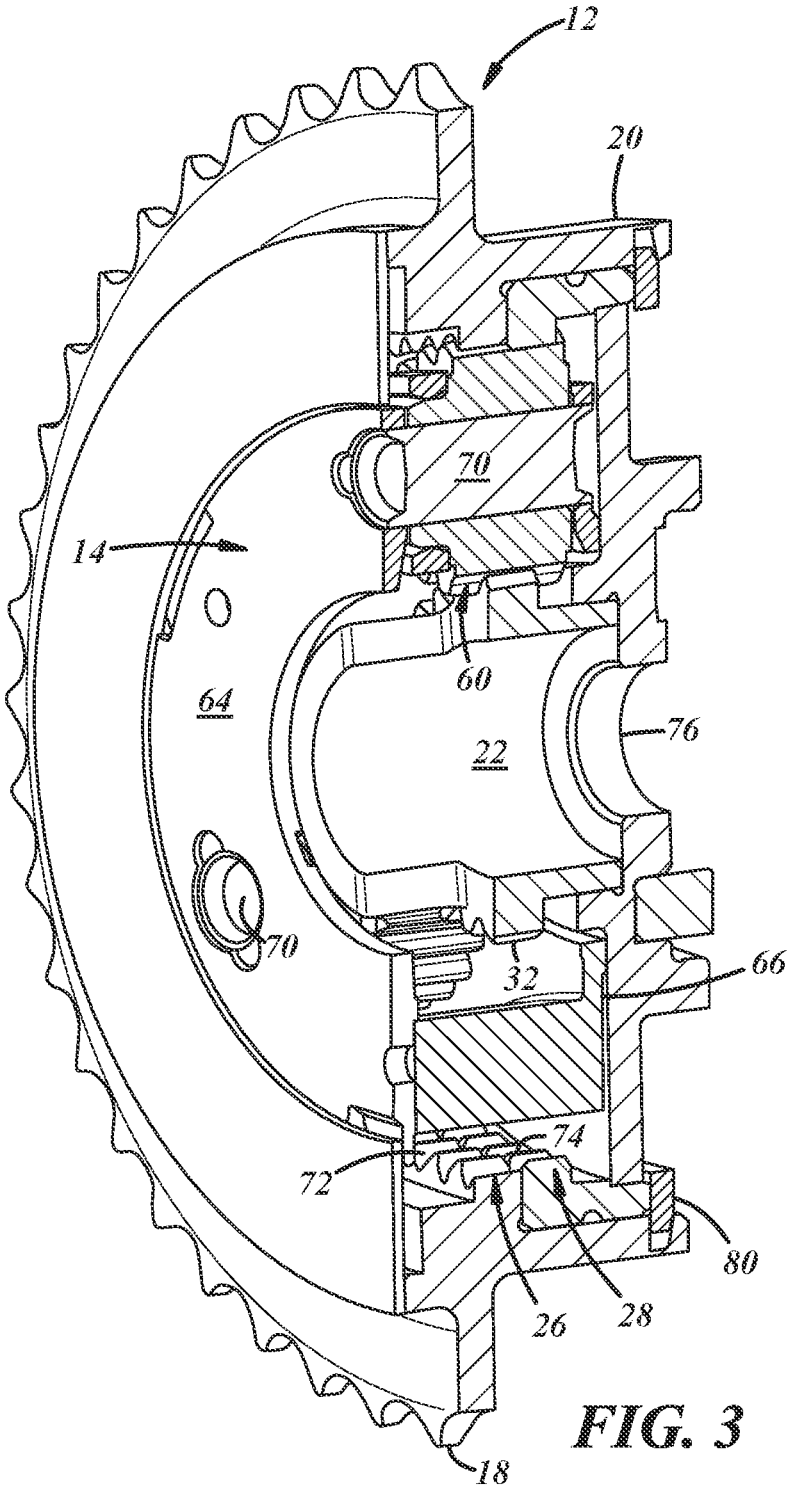
FIG. 3 is a cross-sectional view depicting an implementation of an electrically-actuated VCT assembly.

An embodiment of an electrically-actuated VCT assembly 10 (also referred to as an electrically-actuated camshaft phaser) is shown with respect to FIGS. 1-3. The phaser 10 is a multi-piece mechanism with components that work together to transfer rotation from the engine's crankshaft and to the engine's camshaft, and that can work together to angularly displace the camshaft relative to the crankshaft for advancing and retarding engine valve opening and closing. The phaser 10 can have different designs and constructions depending upon, among other possible factors, the application in which the phaser is employed and the crankshaft and camshaft that it works with. In the embodiment presented in FIGS. 1-3, for example, the phaser 10 includes a sprocket 12, a planetary gear assembly 14, and a camshaft plate or plate 16.

The sprocket 12 receives rotational drive input from the engine's crankshaft and rotates about an axis $X_1$. A timing chain or a timing belt can be looped around the sprocket 12 and around the crankshaft so that rotation of the crankshaft translates into rotation of the sprocket via the chain or belt. Other techniques for transferring rotation between the sprocket 12 and crankshaft are possible. Along an outer surface, the sprocket 12 has a set of teeth 18 for mating with the timing chain, with the timing belt, or with another component. In different examples, the set of teeth 18 can include thirty-eight individual teeth, forty-two individual teeth, or some other quantity of teeth spanning continuously around the circumference of the sprocket 12. As illustrated, the sprocket 12 has a housing 20 spanning axially from the set of teeth 18. The housing 20 is a cylindrical wall that surrounds part of the planetary gear assembly 14.

A planetary gear stop 13 can be included on an inwardly-facing surface of the sprocket 12 to limit the angular displacement between the camshaft and the crankshaft. The planetary gear stop 13 is one implementation of a range-limiting element. The planetary gear stop 13 engages a cushioned stop and prevents further angular displacement between the camshaft and the crankshaft in both an advancing direction and a retarding direction. However, the planetary gear stop 13 can be implemented in a number of different ways. For example, rather than existing as a fixed protuberance extending radially-inwardly from the sprocket 12, the planetary gear stop(s) can move. For example, in one implementation the planetary gear stop can be an element that fits into a pocket of the camshaft ring gear such that the planetary gear stop moves to engage an element included on the planetary gear assembly. In one implementation, the planetary gear stop can pivot about an axis or can slide radially-inwardly or radially-outwardly to engage or disengage the planetary gear assembly 14. A variety of different planetary gear stops are described in U.S. patent application Ser. N. 15/635,281 the entirety of which is incorporated by reference.

In the embodiment presented here, the planetary gear assembly 14 includes planet gears 24. A sun gear 22 is driven by an electric motor 23 for rotation about the axis $X_1$. The sun gear 22 engages with the planet gears 24 and has a set of teeth 32 at its exterior that makes direct teeth-to-teeth meshing with the planet gears 24. In different examples, the set of teeth 32 can include twenty-six individual teeth, thirty-seven individual teeth, or some other quantity of teeth spanning continuously around the circumference of the sun gear 22. A skirt 34 in the shape of a cylinder spans from the set of teeth 32. As described, the sun gear 22 is an external spur gear, but could be another type of gear. The electric motor 23 includes a stator and a rotor (not shown). The rotor can be coupled to a motor shaft 100 in a manner that will be discussed in more detail below. Electric current can be received by windings included with the stator to induce rotational movement of the rotor relative to the stator. The rotational movement of the rotor is communicated to the motor shaft 100. A key 102 can be coupled to a distal end of the motor shaft 100. The key 102 to can be shaped to engage the sun gear 22 and transmit rotation movement from the motor shaft 100 to the planetary gear assembly 14.

The planet gears 24 rotate about their individual rotational axes $X_2$ when in the midst of bringing the engine's camshaft among advanced and retarded angular positions. When not advancing or retarding, the planet gears 24 revolve together around the axis $X_1$ with the sun gear 22 and with the ring gears 26, 28. In the embodiment presented here, there are a total of three discrete planet gears 24 that are similarly designed and constructed with respect to one another, but there could be other quantities of planet gears such as one, two, four or six. However many there are, each of the planet gears 24 can engage with first and second ring gears 26, 28, included with the sprocket 12 and the plate 16, respectively. Each planet gear 24 can have a set of teeth 60 along its exterior for making direct teeth-to-teeth meshing with the ring gears 26, 28. In different examples, the teeth 60 can include twenty-one individual teeth, or some other quantity of teeth spanning continuously around the circumference of each of the planet gears 24. To hold the planet gears 24 in place and support them, a carrier assembly 62 can be provided. The carrier assembly 62 can have different designs and constructions. In the embodiment presented in the figures, the carrier assembly 62 includes a first carrier plate 64 on one side, a second carrier plate 66 on the other side, and cylinders 68 that serve as a hub for the rotating planet gears 24. Planet pins or bolts 70 can be used with the carrier assembly 62. It should be appreciated that other implementations of the planetary gear assembly are possible, such as one using an eccentric shaft and a compound planetary gear or another that uses a harmonic drive. Implementations having one ring gear and a planet gear attached to a camshaft via a coupling are possible as well.

The first ring gear 26 receives rotational drive input from the sprocket 12 so that the first ring gear 26 and sprocket 12 rotate together about the axis $X_1$ in operation. The first ring gear 26 can be a unitary extension of the sprocket 12—that is, the first ring gear 26 and the sprocket 12 can together form a monolithic structure. The first ring gear 26 has an annular shape, engages with the planet gears 24, and has a set of teeth 72 at its interior for making direct teeth-to-teeth meshing with the planet gears 24. In different examples, the teeth 72 can include eighty individual teeth, or some other quantity of teeth spanning continuously around the circumference of the first ring gear 26. In the embodiment presented here, the first ring gear 26 is an internal spur gear, but could be another type of gear.

The second ring gear 28 transmits rotational drive output to the engine's camshaft about the axis $X_1$. In this embodiment, the second ring gear 28 drives rotation of the camshaft via the plate 16. The second ring gear 28 and plate 16 can be connected together in different ways, including by a cutout-and-tab interconnection, press-fitting, welding, adhering, bolting, riveting, or by another technique. In embodiments not illustrated here, the second ring gear 28 and the plate 16 could be unitary extensions of each other to make a monolithic structure. Like the first ring gear 26, the second ring gear 28 has an annular shape, engages with the planet gears 24, and has a set of teeth 74 at its interior for making direct teeth-to-teeth meshing with the planet gears. In different examples, the teeth 74 can include seventy-seven individual teeth, or some other quantity of teeth spanning continuously around the circumference of the second ring gear 28. With respect to each other, the number of teeth between the first and second ring gears 26, 28 can differ by a multiple of the number of planet gears 24 provided. So, for instance, the teeth 72 can include eighty individual teeth, while the teeth 74 can include seventy-seven individual teeth—a difference of three individual teeth for the three planet gears 24 in this example. In another example with six planet gears, the teeth 72 could include seventy individual teeth, while the teeth 74 could include eighty-two individual teeth. Satisfying this relationship furnishes the advancing and retarding capabilities by imparting relative rotational movement and relative rotational speed between the first and second ring gears 26, 28 in operation. In the embodiment presented here, the second ring gear 28 is an internal spur gear, but could be another type of gear. The plate 16 includes a central aperture 76 through which a center bolt 78 passes to fixedly attach the plate 16 to the camshaft. In addition, the plate 16 is also secured to the sprocket 12 with a snap ring 80 that axially constrains the planetary gear assembly 14 between the sprocket 12 and the plate 16.

Together, the two ring gears 26, 28 constitute a split ring gear construction for the camshaft phaser 10. However, it should be appreciated that other camshaft phaser designs can be used with the cushioned stops. For example, the camshaft phaser could be implemented using an eccentric shaft, a compound planet gear, and two ring gears. Or the camshaft phaser could include more than two ring gears. For instance, the camshaft phaser 10 could include an additional third ring gear for a total of three ring gears. Here, the third ring gear could also transmit rotational drive output to the engine's camshaft like the second ring gear 28, and could have the same number of individual teeth as the second ring gear.

Figure 4:
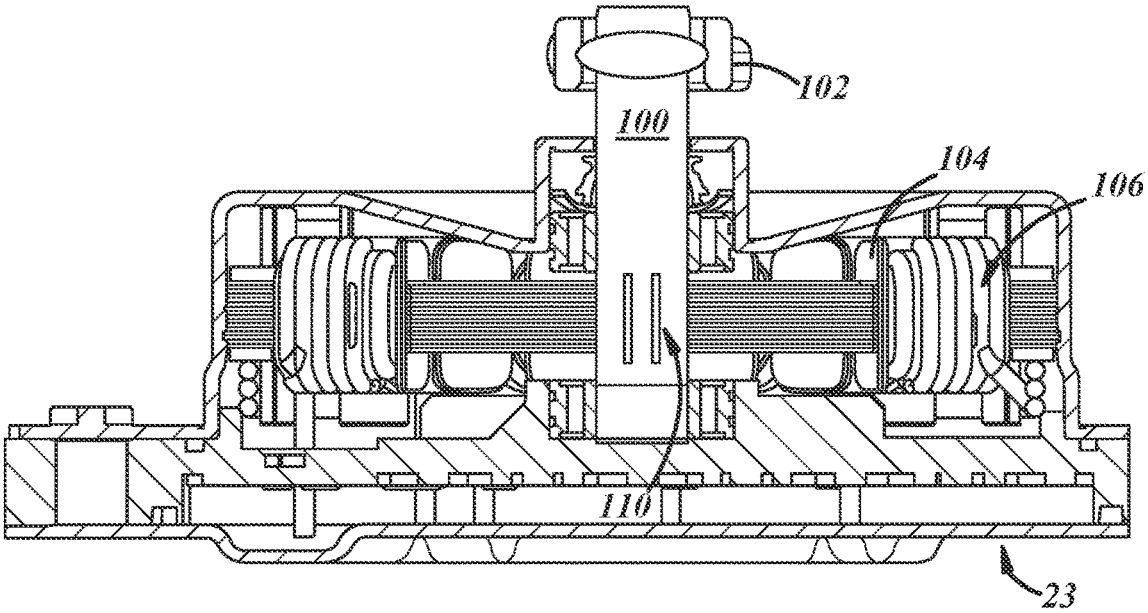
FIG. 4 is a cross-sectional view depicting an implementation of an electric motor used with an electrically-actuated VCT assembly.

A cross-sectional view of the electric motor 23 is shown in FIG. 4. The electric motor 23 is shown with a rotor 104, a stator 106, and the motor shaft 100 mechanically forced into a center aperture 108 of the rotor 104. Etchings 110 have been made over an outer surface of the motor shaft 100 along an axial length of the shaft 100. The etchings 110 abut and engage the center aperture 108 of the rotor 104. The etchings 110 can be a portion of the surface area of the motor shaft 100 that has a different coefficient of friction relative to the remaining surface area of the shaft 100. The etchings 110 can be created by applying a laser to the desired portion of the surface area for a defined amount of time before assembly with the rotor 104. The application of the laser can change the coefficient of friction of the portion of the surface area by melting an outer surface of the motor shaft 100. In one implementation, a laser can apply the laser beam to the surface of the motor shaft 100 for a defined period of time. The energy of the laser beam and duration of application can be influenced by the material of the motor shaft 100 and shape of the portion of the surface area of the motor shaft 100 to be etched.

Figure 5:
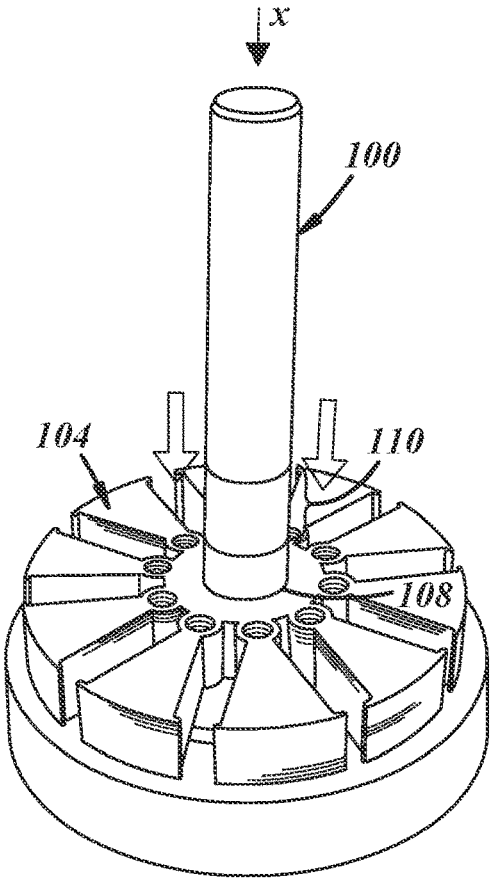
FIG. 5 is a perspective view depicting an implementation of a rotor and motor shaft used with the electric motor.
Figure 6:
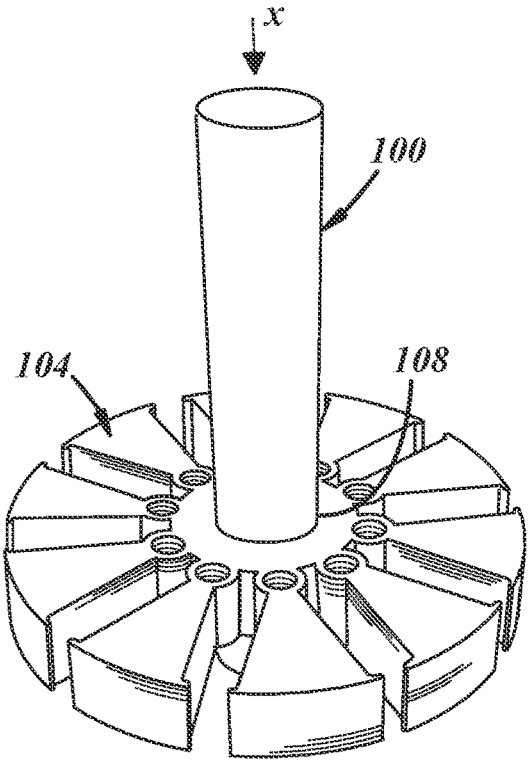
FIG. 6 is a perspective view depicting an implementation of a rotor and motor shaft used with the electric motor.

The motor shaft 100 with etchings 110 and rotor 104 are shown in a pre-assembled state in FIG. 5 and as an assembly in FIG. 6. The motor shaft 100 can be mechanically pressed into the center aperture 108 of the rotor 104 until the etchings 110 axially align with the rotor 104 along an axis of rotation (x). The etchings 110 engage the rotor 104 via the center aperture 108 thereby resisting angular displacement of the motor shaft 100 relative to the rotor 104. The coefficient of friction of the etchings 110 can be increased or decreased depending on an amount of torque needed to angularly displace the motor shaft 100 relative to the rotor 104.

Figure 7:
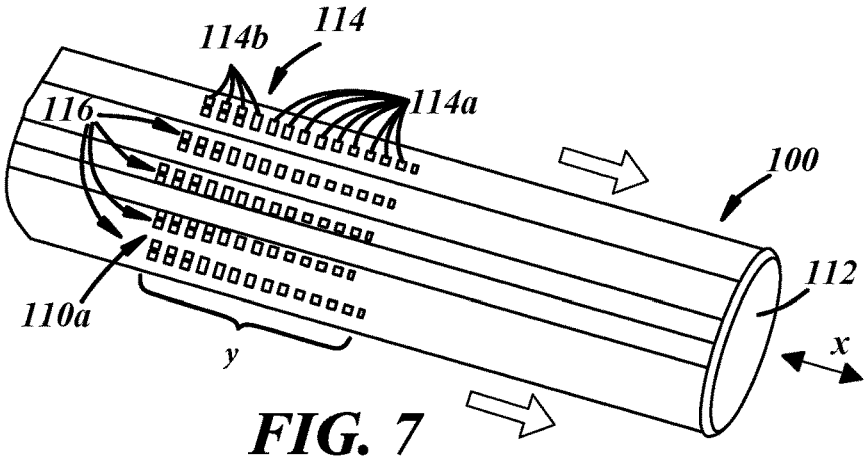
FIG. 7 is a perspective view depicting an implementation of a motor shaft with etchings.

The etchings on the portion of the surface area of the motor shaft 100 can be shaped in different ways to control the amount of torque needed to angularly displace the motor shaft 100 relative to the rotor 104. In some implementations, the portion of the surface area of the motor shaft 100 can include a pattern that increases in surface area extending in an axial direction. Turning to FIG. 7, etchings 110*a* are shown as triangular splines 116 that increase in circumferential width around the circumference of the motor shaft 100 moving from a distal end 112 of shaft 100 that is first inserted in the center aperture 108 toward the electric motor 23. The triangular splines can extend an axial length (y) of the motor shaft 100 and comprise a plurality of etched dots 114 that collectively form the triangular shape.

For example, one etched dot 114*a* can be positioned at the beginning of the etchings 110*a* at an axial location along the axis of rotation (x) and additional dots 114*a* having increasingly greater circumferential widths can be placed at axial positions increasingly further away from the distal end 112. Then two dots 114*b* can be positioned at an axial point along the axis of rotation (x) further from distal end 112 and dot 114*a*. The two dots 114*b* can increase in circumferential width as additional dots 114*b* are placed further away from the distal end 112 on the surface of the motor shaft 100. The narrower width of the etchings 110*a* toward the distal end 112 can help create a stronger bond between the etchings 110*a* and the rotor 104 after insertion into engagement with the center aperture 108. As the motor shaft 100 is pressed into the center aperture 108 so that the etchings 110*a* engage the rotor material, the portion of the etchings 110*a* nearest the distal end 112 disturb the material of the rotor 104 that it engages, such as the dots 114*a*. However, subsequent wider etchings 110*a*, such as dots 114*b*, engage fresh rotor material that has not been previously disturbed by another part of the etchings 110*a* , such as dots 114*a*, based on the axial movement of the motor shaft 100 relative to the rotor 104.

Figure 8:
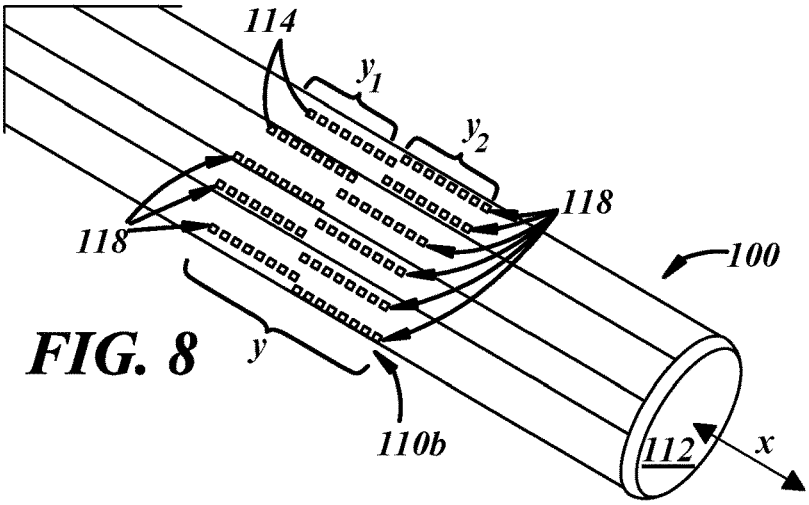
FIG. 8 is a perspective view depicting another implementation of a motor shaft with etchings.

Another implementation of the etchings 110*b* is shown in FIG. 8. The etchings 110*b* include rectangular splines 118 of relatively uniform length extending along an axial length (y) of the motor shaft 100. The rectangular splines 118 can comprise a plurality of uniformly shaped dots 114 that extend a portion of the axial length (y) of the motor shaft 100. A first group of rectangular splines 118 can extend axially along a first axial section (y1) of the motor shaft 100 and a second group of rectangular splines 118 can extend axially along a second axial section (y2) of the motor shaft 100. The first group of rectangular splines 118 can be angularly displaced from the second group of rectangular splines 118 relative to the axis of rotation (x).

Figure 9:
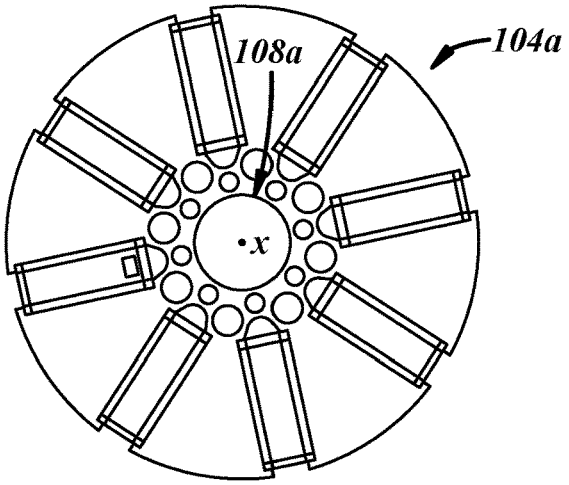
FIG. 9 is a profile view depicting an implementation of a rotor.

Turning to FIGS. 9 and 10, an implementation of the rotor 104*a* is shown having a non-circular center aperture 108*a*. The non-circular center aperture 108*a* can permit the aperture 108*a* or bore to elastically deform or flex to facilitate assembly of the motor shaft 100 into rotor 104*a*. The non-circular center aperture 108*a* can also help regulate the pressure or force between the motor shaft 100 and the rotor 104*a* after assembly compared to a press-fit assembly using a circular center aperture. In one implementation, the non-circularity can be created with a plurality of protuberances 120 that extend radially-inwardly toward the axis of rotation (x) and are circumferentially spaced along an aperture surface that radially-inwardly faces toward the etchings 110 and the outer surface of the motor shaft 100.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. An electrically-actuated variable camshaft timing (VCT) assembly, comprising:

a gearbox assembly configured to change an angular position of a camshaft relative to a crankshaft, the gearbox assembly including an input; and an electric motor including a rotor, a stator, and a motor shaft coupled to the input, wherein an outer surface of the motor shaft, includes etchings configured to releasably couple the motor shaft to the rotor at a center aperture of the rotor when an amount of torque exerted on the motor shaft via the gearbox assembly is less than or equal to a predetermined torque value, and the etchings are further configured to decouple the motor shaft from the rotor when the amount of torque exerted on the motor shaft is greater than the predetermined torque value.

2. The electrically-actuated VCT assembly recited in claim 1, wherein the etchings form a plurality of triangular splines.

3. The electrically-actuated VCT assembly recited in claim 1, wherein the etchings form a plurality of rectangular splines.

4. The electrically-actuated VCT assembly recited in claim 3, wherein the plurality of rectangular splines includes a first group of rectangular splines and a second group of rectangular spline angularly displaced from the first group of rectangular splines.

5. The electrically-actuated VCT assembly recited in claim 1, wherein the etchings comprise a plurality of dots.

6. The electrically-actuated VCT assembly recited in claim 1, wherein the center aperture is a non-circular center aperture.

7. The electrically-actuated VCT assembly recited in claim 6, wherein the non-circular center aperture comprises one or more radially-inwardly extending protuberances.

8. The electrically-actuated VCT assembly recited in claim 1, wherein the gearbox assembly further includes a plurality of planet gears and a sun gear engaging the plurality of planet gears.

9. An electrically-actuated variable camshaft timing (VCT) assembly, comprising:

a first ring gear configured to receive rotational input from a crankshaft;

a second ring gear configured to couple to a camshaft;

a gearbox assembly configured to engage the first ring gear and the second ring gear so as to angularly displace the first ring gear relative to the second ring gear, the gearbox assembly including an input; and an electric motor including a rotor, a stator, and a motor shaft coupled to the input, wherein an outer surface of the motor shaft includes etchings configured to releasably engage a center aperture of the rotor.

10. The electrically-actuated VCT assembly recited in claim 9, wherein the etchings form a plurality of triangular splines.

11. The electrically-actuated VCT assembly recited in claim 9, wherein the etchings form a plurality of rectangular splines.

12. The electrically-actuated VCT assembly recited in claim 11, wherein the plurality of rectangular splines includes a first group of rectangular splines and a second group of rectangular splines angularly displaced from the first group of rectangular splines.

13. The electrically-actuated VCT assembly recited in claim 9, wherein the etchings comprise a plurality of dots.

14. The electrically-actuated VCT assembly recited in claim 9, further comprising wherein the center aperture is a non-circular center aperture.

15. The electrically-actuated VCT assembly recited in claim 14, wherein the non-circular center aperture comprises one or more radially-inwardly extending protuberances.

* * * * *